US008464717B2

(12) United States Patent
Greter

(10) Patent No.: US 8,464,717 B2
(45) Date of Patent: Jun. 18, 2013

(54) BREATHING MASK WITH AN AUTONOMOUS INFLATABLE HARNESS

(75) Inventor: Vincent Greter, Elancourt (FR)

(73) Assignee: Intertechnique (FR)

( * ) Notice: Subject to any disclaimer, the term of this patent is extended or adjusted under 35 U.S.C. 154(b) by 933 days.

(21) Appl. No.: 12/376,574

(22) PCT Filed: Aug. 2, 2007

(86) PCT No.: PCT/EP2007/057997

§ 371 (c)(1),
(2), (4) Date: Jul. 2, 2009

(87) PCT Pub. No.: WO2008/017630

PCT Pub. Date: Feb. 14, 2008

(65) Prior Publication Data

US 2010/0126511 A1 May 27, 2010

Related U.S. Application Data

(60) Provisional application No. 60/836,797, filed on Aug. 10, 2006.

(51) Int. Cl.
*A62B 18/08* (2006.01)

(52) U.S. Cl.
USPC ..... 128/206.24; 128/206.26; 128/207.11

(58) Field of Classification Search
USPC ..... 128/205.21, 205.22, 205.24, 205.25, 128/200.24, 201.22–202.11, 203.12, 203.29, 128/204.18, 204.22, 204.29, 206.23, 206.24, 128/206.26–207.11; 244/118.5
See application file for complete search history.

(56) References Cited

U.S. PATENT DOCUMENTS

| | | | | |
|---|---|---|---|---|
| 2,292,568 | A | 8/1942 | Kanter et al. | |
| 3,018,776 | A | 1/1962 | Saitta et al. | |
| 4,157,090 | A | 6/1979 | Phillips | |
| 6,039,045 | A * | 3/2000 | Bertheau et al. | 128/207.11 |
| 6,470,887 | B1 | 10/2002 | Martinez | |
| 6,886,559 | B2 * | 5/2005 | McDonald et al. | 128/201.24 |
| 6,923,183 | B2 * | 8/2005 | Martinez et al. | 128/206.27 |
| 6,994,086 | B1 * | 2/2006 | Martinez et al. | 128/204.26 |
| 8,028,700 | B2 * | 10/2011 | Hannah et al. | 128/206.28 |
| 2002/0157668 | A1 | 10/2002 | Bardel | |

FOREIGN PATENT DOCUMENTS

| | | |
|---|---|---|
| EP | 0705622 | 4/1996 |
| FR | 2778575 | 11/1999 |
| WO | WO9310858 | 6/1993 |
| WO | WO0168187 | 9/2001 |

* cited by examiner

*Primary Examiner* — Glenn Richman
(74) *Attorney, Agent, or Firm* — Dean W. Russell; Kristin M. Crall; Kilpatrick Townsend & Stockton LLP

(57) ABSTRACT

A breathing mask (1) for aircraft crewmember or passenger comprises a rigid portion (3) to be fit against the face of an user, said rigid portion comprising elements to bring a breathable gas to the user. The breathing mask further comprises an extensible harness (4) having end portions (5) connected to said rigid portion and including an inflatable element (6) connected to a source (7) of pressurized gas through a manually operable valve which delivers the pressurized gas to the inflatable element for extending the harness when actuated, and which reduces the pressure in said inflatable element to retract the harness and to cause the rigid portion to engage the face of the user when released. The source of pressurized gas is an autonomous container (7) supported by the rigid portion and containing the pressurized gas.

15 Claims, 2 Drawing Sheets

BREATHING MASK WITH AN AUTONOMOUS INFLATABLE HARNESS

CROSS REFERENCE TO RELATED APPLICATIONS

This application is the U.S. national phase of International Application No. PCT/EP2007/057997 filed on Aug. 2, 2007 and published in English on Feb. 14, 2008 as International Publication No. WO 2008/017630 A1, which claims priority to U.S. Provisional Application No. 60/836,797 filed on Aug. 20, 2006, the entire contents of both of which are incorporated herein in their entireties by reference.

FIELD OF THE INVENTION

The invention relates to the field of breathing mask for aircraft crew members and passengers.

BACKGROUND OF THE INVENTION

To ensure the safety of the passengers and crewmembers in case of a depressurization accident or the occurrence of smoke in the aircraft, aviation regulations require on board all airliners a safety oxygen supply circuit able to supply each passenger and crewmember with an oxygen flow rate which is function of the cabin altitude.

A mask and harness system is use to provide breathing oxygen. The mask system has a face seal, a pneumatically-actuated harness, and a regulator with microphone to control the flow of oxygen and to facilitate communications in aircraft flight decks and other aircraft compartments. The system is designed for a required five-second donning with one hand. It is connected to an oxygen source and, optionally, to aircraft communications.

The usual method consists of using available pressure at the inlet of pressure regulator (which is usually closed to the harness body) in order to deploy the harness to allow the mask user to put it on his head. This method is not possible in the following cases:

- when the pressure regulator is not close to the harness (for example control panel regulator in military applications),
- when pressure supply is not sufficient due to, for instance, the use of On Board Oxygen Regulator.

In those cases, to perform the task of donning the mask, a mechanical harness is usually used. However, the usual mechanical harness is heavy, bulky and expensive. A second solution consists to require the crewmember to wear his mask permanently (which can be fixed to his helmet, for instance). This second option is very uncomfortable and generates a permanent usury of the equipment for a very low probability of risk.

SUMMARY OF THE INVENTION

It would advantageous to achieve a breathing apparatus which has the comfort of a pneumatic harness without the need to connect the harness to high pressure gas to inflate it.

To better address one or more concerns, in a first aspect of the invention a breathing mask for aircraft crewmember or passenger comprises a rigid portion to be fit against the face of an user, said rigid portion comprising elements to bring a breathable gas to the user. The said breathing mask further comprises an extensible harness having end portions connected to said rigid portion and including an inflatable element connected to a source of pressurized gas through a manually operable valve which delivers the pressurized gas to the inflatable element for extending the harness when actuated, and which reduces the pressure in said inflatable element to retract the harness and to cause the rigid portion to engage the face of the user when released, wherein said source of pressurized gas is an autonomous container rigidly fixed to the rigid portion and containing the pressurized gas.

In particular embodiments:

- the autonomous container is sealed before use and the breathing mask further comprises a manually operable striker adapted to pierce the container the first time the user actuates the valve to inflate the inflatable element.
- the autonomous container is a disposable bottle to be changed after use.
- a visible sign is disposed on, said visible sign having a different appearance when the autonomous container is sealed and when the autonomous container is pierced.
- the visible sign is a seal which is broken by the striker when it pierces the autonomous container.
- said striker is operable through a lever, said lever being adapted to move said valve to the position to deliver the pressurized gas at the same time that it moves the striker to pierce the container.
- a pressure reducer is inserted between the autonomous container and the inflatable portion.
- a security valve is disposed between the pressure reducer and the inflatable portion, said security valve being adapted to limit the pressure in the inflatable portion below 90 Newton per square centimeter.

Therefore, the breathing mask has the advantage of the comfort of an inflatable harness without the requirement of a connection to an external source of gas having a pressure sufficient to inflate the harness.

Advantageously, the sealed container maintains the pressurized gas for an almost unlimited time as no leakage is possible.

With a disposable container, the breathing mask has the advantage to be easily maintained after use as only a change of bottle is necessary. And an external sign advantageously guarantees the user that the operation was correctly done and that the breathing mask is ready to use.

A seal is advantageously a low cost and efficient means to guarantee that a new bottle is installed in the breathing mask.

The manipulation of the value by the lever is reducing advantageously the number of moving parts of the breathing mask and thus, increasing its reliability. And it guarantees that the valve is in the correct position to inflate the harness when the seal of the bottle is broken.

The pressure reducer decreases advantageously the gas pressure at a level which is not damaging the harness. At the same time, it regulates the pressure to a constant pressure even if the bottle is used many times with a pressure in the bottle reducing at each use.

In case of default of the pressure reducer, the security valve advantageously protects the harness.

These and other aspects of the invention will be apparent from and elucidated with reference to the embodiment described hereafter in relation with annexed figures where:

Figure 1:
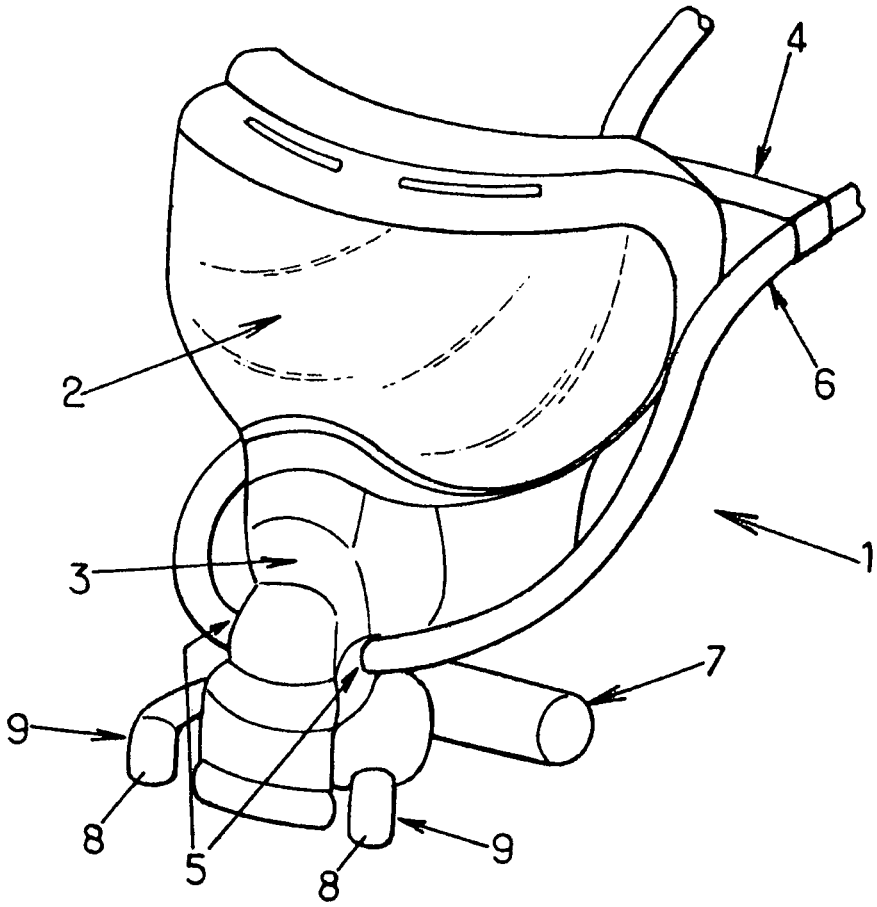
FIG. 1 is a perspective view of a breathing mask according to an embodiment of the invention

In reference to FIG. 1, a breathing mask 1 comprises a glass 2 fixed to a rigid portion 3. The rigid portion has a form adapted to be fit against the face of a user and comprises elements (not shown) to bring a breathable gas to the user. The breathing mask comprises also an extensible harness 4 having end portions 5 connected to the rigid portion. The harness includes an inflatable element 6 connected to a source 7 of pressurized gas. The source 7 of pressurized gas is an autonomous container rigidly fixed to the rigid portion and containing the pressurized gas.

Movable elements 8 have ergonomic surfaces 9 for enabling a user to press the movable elements inwardly with a pinching movement.

Figure 2:
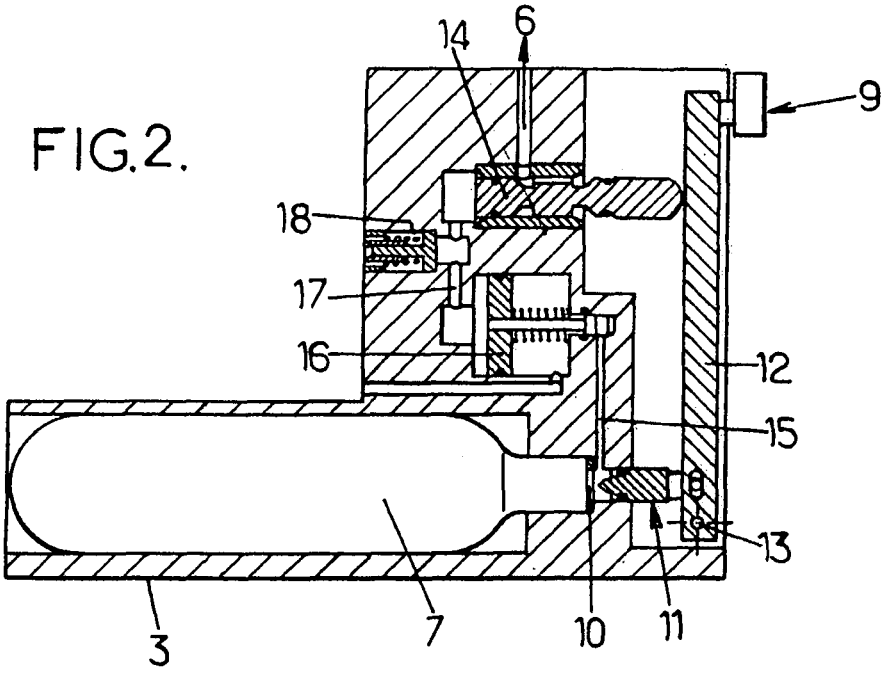
FIG. 2 is a functional view of a mechanical apparatus embodying the invention.

FIG. 2 is a functional scheme of the mechanical apparatus connecting the source 7 of pressurized gas to the inflatable element 6.

The source 7 is a cylinder containing carbonic gas ($CO_2$) at high pressure fixed to the rigid portion 3. Typically the source 7 is a metallic bottle containing 10 grams of CO2 under a pressure of more than 1650 Newton per square centimeter.

The metallic bottle is air tightly closed by a burst disk 10. A striker 11 is controlled by a lever 12. The lever 12 is rotating around an axis 13 and is connected by its opposite side to one of the ergonomic surfaces 9. The lever 12 controls also a manually operable valve 14 which delivers the regulated pressurized gas to the inflatable element 6. A duct 15 connects the output of the source 7 to a pressure reducer 16. A second duct 17 connects the output of the pressure reducer 16 to the valve 14. A security valve 18 is connected on the duct 16.

When the user needs to inflate the harness 4, he pushes the lever 12 by means of the ergonomic surfaces 9. The lever 12 pushes the striker 11 against the burst disk 10 until the burst disk of the cartridge breaks. The pressurized gas from the source 7 flows to the harness through the ducts 15, 17. The pressure reducer 16 is calibrated to reduce the pressure of the gas from the initial 1650 Newton per square centimeter to around 75 Newton per square centimeter which is the pressure adapted to inflate the harness without damaging it. The security valve 18 is calibrated to release the gas outside if the pressure in the duct 17 is above 90 Newton per square centimeter.

By pushing the lever 12, the valve 14 is moved in a position where the pressurized gas can flow from the duct 17 to the inflatable element 6 for extending the harness. When the lever 12 is released, the valve 14 moves in an open position connecting the inflatable element to the outside which reduces the pressure in the inflatable element. The harness is retracted to cause the rigid portion to engage the face of the user.

While the invention has been illustrated and described in details in the drawings and foregoing description, such illustration and description are to be considered illustrative or exemplary and not restrictive; the invention is not limited to the disclosed embodiment.

Figure 3:
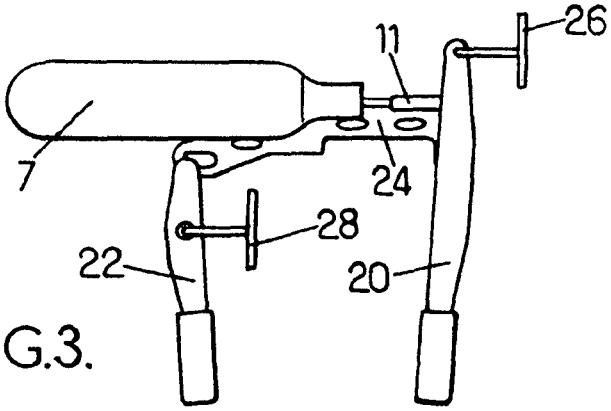
FIG. 3 is another embodiment of a lever according to the invention.

For instance, the lever 12 may be replaced by a system of 2 levers 20, 22, FIG. 3, connected together through a piece 24 and rotating around a first axis 26 for the first lever 20 and a second axis 28 for the second lever 22. This embodiment has the advantage to increase the lever effect and to reduce the strength that the user needs to apply to the levers to pierce the source 7.

Figure 4:
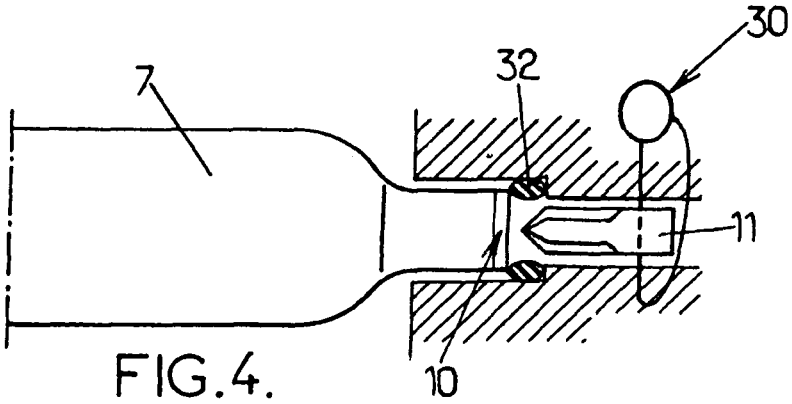
FIG. 4 is a schematic view of a seal to protect a bottle of pressurized gas according to an embodiment of the invention.

As a security feature, FIG. 4, a seal 30 is fixed to the striker 11 so that the movement of the striker to pierce the source 7 breaks the seal. The seal creates a sign disposed on the breathing mask and visible by the user. The visible sign has a different appearance when the autonomous container is sealed and when the autonomous container is pierced, so that the user knows beforehand if the breathing mask is ready for use.

A joint 32, typically a O-ring, is surrounding the burst disk 10 to avoid any leakage of the pressurized gas when the burst disk 10 is broken by the striker 11.

The sticker 11 has advantageously a cross-threaded joint to avoid that the striker stops up the opening done into the burst disk and prevents the gas to flow into the duct 15.

Other variations to the disclosed embodiments can be understood and effected by those skilled on the art in practicing the claimed invention, from a study of the drawings, the disclosure and the appended claims. In the claims, the word "comprising" does not exclude other elements and the indefinite article "a" or "an" does not exclude a plurality.

The invention claimed is:

1. Breathing mask for aircraft crewmember or passenger comprising a rigid portion to be fit against the face of a user, said rigid portion comprising elements to bring a breathable gas to the user, said breathing mask further comprising an extensible harness having end portions connected to said rigid portion and including an inflatable element connected to a source of pressurized gas through a manually operable valve which delivers the pressurized gas to the inflatable element for extending the harness when actuated, and which reduces the pressure in said inflatable element to retract the harness and to cause the rigid portion to engage the face of the user when released, wherein said source of pressurized gas is an autonomous container supported by the rigid portion and containing the pressurized gas.

2. Breathing mask according to claim 1, wherein the autonomous container is sealed before use and the breathing mask further comprises a manually operable striker adapted to pierce the container the first time the user actuates the valve to inflate the inflatable element.

3. Breathing mask according to claim 2, wherein the autonomous container is a disposable bottle to be changed after use.

4. Breathing mask according to claim 2, wherein a visible sign is disposed on, said visible sign having a different appearance when the autonomous container is sealed and when the autonomous container is pierced.

5. Breathing mask according to claim 4, wherein the visible sign is a seal which is broken by the striker when it pierces the autonomous container.

6. Breathing mask according to claim 2, wherein said striker is operable through a lever, said lever being adapted to move said valve to the position to deliver the pressurized gas at the same time that is moves the striker to pierce the container.

7. Breathing mask according to claim 1, wherein a pressure reducer is inserted between the autonomous container and the inflatable portion.

8. Breathing mask according to claim 7, wherein a security valve is disposed between the pressure reducer and the inflatable portion, said security valve being adapted to limit the pressure in the inflatable portion below 90, Newton per square centimeter.

9. Breathing mask according to claim 7, wherein the autonomous container is adapted to inflate the harness many times.

10. Breathing mask according to claim 9, wherein the autonomous container is distinct from said elements bringing a breathable gas to the user.

11. Breathing mask according to claim 9, wherein the autonomous container is rigidly fixed to the rigid portion.

12. Breathing mask according to claim 7, wherein the autonomous container is distinct from said elements bringing a breathable gas to the user.

13. Breathing mask according to claim 1, wherein the autonomous container is adapted to inflate the harness many times.

14. Breathing mask according to claim 1, wherein the autonomous container is distinct from said elements bringing a breathable gas to the user.

15. Breathing mask according to claim 1, wherein the autonomous container is rigidly fixed to the rigid portion.

* * * * *